US006682179B2

(12) United States Patent
Takahagi et al.

(10) Patent No.: US 6,682,179 B2
(45) **Date of Patent: *Jan. 27, 2004**

(54) INK JET PRINT HEAD AND METHOD OF PRODUCTION THEREOF

(75) Inventors: Hiroshi Takahagi, Hitachinaka (JP); Nobuhiro Noto, Hitachinaka (JP); Kenichi Kugai, Hitachinaka (JP); Nobuhiro Kurosawa, Hitachinaka (JP); Kenji Yamada, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 27 days.

This patent is subject to a terminal disclaimer.

(21) Appl. No.: 10/093,059

(22) Filed: Mar. 8, 2002

(65) Prior Publication Data

US 2002/0126186 A1 Sep. 12, 2002

(30) Foreign Application Priority Data

Mar. 8, 2001 (JP) ..... P2001-065404

(51) Int. Cl.[7] ..... B41J 2/045
(52) U.S. Cl. ..... 347/70; 347/68
(58) Field of Search ..... 347/54, 68.72; 29/25.35, 890.1; 310/324, 328

(56) References Cited

U.S. PATENT DOCUMENTS 5,446,485 A * 8/1995 Usui et al. ..... 347/72
6,530,652 B1 * 3/2003 Kim et al. ..... 347/70

FOREIGN PATENT DOCUMENTS

JP 403184411 A * 8/1991 ..... 333/187

* cited by examiner

*Primary Examiner*—Stephen D. Meier
*Assistant Examiner*—An H. Do
(74) *Attorney, Agent, or Firm*—Whitham, Curtis & Christofferson, PC

(57) ABSTRACT

An ink jet print head includes pressure chambers, nozzles, and ink channels in a one-to-one correspondence. A diaphragm forms a side of each pressure chamber. The ink channels are formed in a restrictor plate. Piezoelectric elements are attached to the diaphragm and to a piezoelectric element fixing plate, which supports the piezoelectric elements. A housing of the head is formed with a common ink channel for supplying ink to the ink channels and an internal space into which the piezoelectric elements and the piezoelectric element fixing plate are at least partially inserted. A cover is provided for covering the piezoelectric element fixing plate. The cover is connected to the housing and is provided with an internal space large enough to maintain a gap between the cover and the piezoelectric element fixing plate.

10 Claims, 13 Drawing Sheets

INK JET PRINT HEAD AND METHOD OF PRODUCTION THEREOF

BACKGROUND OF THE INVENTION

1. Field of the Invention

The present invention relates to an ink jet print head for use in an office or industrial environment, and also to a method of producing the ink jet print head.

2. Description of the Related Art

FIG. 1 is a cross-sectional view showing an example of a conventional ink jet print head. The ink jet print head includes an orifice plate 102 formed with a nozzle 101, a chamber plate 104 formed with a pressure chamber 103, a restrictor plate 106 formed with a restrictor 105, a diaphragm/filter plate 109 formed with a diaphragm 107 and a filter 108, a housing 111 formed with a common ink channel 110, a piezoelectric element 112, and a piezoelectric element fixing plate 113 for fixing the piezoelectric element 112 in place. The piezoelectric element 112 is made up of a number of plate-shaped piezoelectric material pieces and a number or electrodes alternately stacked one on the other. For the sake of brevity, the piezoelectric element will be hereinafter referred to simply as "piezoelectric element".

The housing 111 includes edges X1 and Y1 for setting the position of the piezoelectric element fixing plate 113 in the X and Y directions, respectively. The piezoelectric element fixing plate 113 is abutted against and fixed to the edges X1 and Y1 by adhesive (not shown). The adhesive must be applied according to the machining precision or the positioning edges X1, Y1 and must be applied thinly.

However, in order to reduce variation in ink ejection, the diaphragm 107 and the piezoelectric element 112 need to be attached to each other with great positional accuracy. This requires that the housing 111 and the piezoelectric element fixing plate 112 be machined with extreme precision. For example, the distance from the positioning edge Y2 of the piezoelectric element fixing plate 113 to where the piezoelectric element 112 is adhered to the diaphragm 107 must be extremely precise so the positioning edges X1, Y1 must be machined in the housing 111 with extremely high precision. Also, the corners between various surfaces must be extremely close to perfect right angles. If not, the surface X1 adhered to the piezoelectric element fixing plate 113 will lean toward or away from the diaphragm 107, so that the surface of the piezoelectric element 112 that is adhered to the diaphragm 107 will also slant with regard to the diaphragm 107. Full and uniform contact between the adhered surfaces of the piezoelectric element 112 and the diaphragm 107 cannot be achieved.

If the adhesive layer is too thin or non-uniform, then the piezoelectric element fixing plate 113 cannot be adhered in accordance with the reference edges X1, Y1. As a result, the adhering surfaces of the diaphragm 107 and the piezoelectric element 112 will not contact each other uniformly, resulting in the diaphragm 107 and the piezoelectric element 112 being adhered to each other at a slant.

When the housing ill and the piezoelectric element fixing plate 113 are made from different materials having different thermal expansion coefficients, then the ink jet head can suffer from warping if the piezoelectric element fixing plate 113 is fixed to the housing 111 by adhesive, for example. The warping can result in variations in ink ejection properties, especially at the end nozzles.

For these reasons, in order to reduce variation in ink ejection, the precision of all components and the thickness of the adhesive must be managed carefully. Components such as the housing 111 and the piezoelectric element fixing plate 113 must be made with high machining precision and so are expensive. As a result, the ink jet head is expensive to make.

SUMMARY OF THE INVENTION

In view of the foregoing, it is an object of the present invention to overcome the above-described problems and to provide an inexpensive ink jet print head with reduced variation in ink ejection properties and a method of manufacturing the ink jet print head.

In order to achieve the above and other objects, an ink jet print head according to the present invention includes a pressure chamber portion, an orifice plate, a restrictor plate, a diaphragm, piezoelectric elements, a piezoelectric element fixing plate, a housing, and a cover.

The pressure chamber portion has pressure chambers. The orifice plate is formed with nozzles in a one-to-one correspondence with the pressure chambers. Each nozzle brings a corresponding pressure chamber into fluid communication with atmosphere. The restrictor plate is formed with ink channels in fluid communication with the pressure chambers. The diaphragm forms a side of the pressure chambers. The piezoelectric elements are attached to the diaphragm in a one-to-one correspondence with the pressure chambers. Each piezoelectric element generates, through the diaphragm, a pressure fluctuation in a corresponding pressure chamber when applied with an electric signal. The piezoelectric element fixing plate is fixedly attached to and supports the piezoelectric elements.

The housing includes a common ink channel portion and internal side walls. The common ink channel portion is formed with a common ink channel in fluid communication with the channels in the restrictor plate. The internal side walls adjoin the diaphragm at one side to define a space that opens at an end opposite from the diaphragm. The piezoelectric element fixing plate and the piezoelectric elements are disposed at least partially in the space with a gap existing between the piezoelectric element fixing plate and the internal side walls that define the space.

The cover covers the piezoelectric element fixing plate. The cover is connected to the housing and is provided with an internal space large enough to maintain a gap between the cover and the piezoelectric element fixing plate.

With this configuration, the cover covers the piezoelectric element fining plate and moreover has an internal space large enough so that the piezoelectric element fixing plate can be inserted into while the gap is maintained between the housing and the piezoelectric element fixing plate. Because the internal space in the cover is, in the same manner as the opening in the housing, larger than the both piezoelectric element and the piezoelectric element fixing plate to which the piezoelectric element is fixed, the ink seal and the cover can be fixed on the housing without any external pressure being applied to the piezoelectric element fixing plate. As a result, the ink jet print head is less expensive and has fewer variations in ink ejection properties.

According to a method of the present invention, a piezoelectric element set, a front end set, and a positioning plate are prepared, but not necessarily in this order.

The piezoelectric element set includes a piezoelectric element fixing plate and piezoelectric elements. The piezoelectric elements are attached to the piezoelectric element fixing plate with a predetermined positioning.

The front end set includes a pressure chamber portion, an orifice plate, a restrictor plate, a diaphragm, and a housing.

The pressure chamber portion has pressure chambers with positioning that corresponds to positioning of the piezoelectric elements on the piezoelectric element fixing plate. The orifice plate is formed with nozzles in a one-to-one correspondence with the pressure chambers. Each nozzle brings a corresponding pressure chamber into fluid communication with atmosphere. The restrictor plate is formed with ink channels in fluid communication with the pressure chambers. The diaphragm forms a side of the pressure chambers.

The housing of the front end set includes a common ink channel, a space, and positioning holes. The common ink channel is in fluid communication with the channels in the restrictor plate. The space is defined by internal side walls that adjoin the diaphragm at one side. The space is open at an open end thereof opposite from the diaphragm. The space is large enough to insert through the open end the piezoelectric elements and the piezoelectric element fixing plate until the piezoelectric elements contact the diaphragm, while a gap is maintained between the side walls and the piezoelectric element fixing plate. The positioning holes are disposed with a predetermined positioning.

The positioning plate includes dummy chambers and positioning holes. The dummy chambers have positioning that corresponds to positioning of the pressure chamber in the pressure chamber portion. The positioning holes have positioning that corresponds to positioning of the positioning holes.

Once the piezoelectric element set, the front end set, and the positioning plate are prepared, the positioning holes of the positioning plate are mounted on positioning pins or a positioning jig. The positioning pins of the positioning jig have a fixed positioning that corresponds to the positioning of the positioning holes of the positioning plate.

Then, the piezoelectric elements of the piezoelectric element set are aligned with the dummy chambers of the positioning plate while observing the piezoelectric elements through the dummy chambers of the positioning plate.

Next, the positioning plate is removed from the positioning jig and the front end set is mounted on the positioning jig. The front end set is mounted on the positioning jig by mounting the positioning holes of the housing on the positioning pins of the positioning jig.

Next, adhesive is coated on either the diaphragm of the front end set or the piezoelectric elements of the piezoelectric element set.

Next, the positioning jig is used to move the front end set toward the piezoelectric element set, while maintaining alignment between the front end set and the piezoelectric element set, until the piezoelectric element set passes into the space and the diaphragm and the piezoelectric elements contact each other.

Then, the front end set and the piezoelectric element set are removed from the positioning jig. The piezoelectric element fixing plate is covered with a cover while maintaining a gap between the cover and the piezoelectric element fixing plate. The cover is attached to the front end set while maintaining the gap between the cover and the piezoelectric element fixing plate.

With this method, the piezoelectric element fixing plate is covered with the cover while the gap is maintained between the cover and the piezoelectric element fixing plate. As a result, the cover can be fixed on the housing without any external pressure being applied to the piezoelectric element fixing plats. Also, the ink jet print head is less expensive and has fewer variations in ink ejection properties. Further, in the case when sealing is applied to prevent ink leaks, the cover prevents any external pressure from being applied to the piezoelectric element fixing plate.

Because the piezoelectric elements are already properly positioned with respect to the positioning plate the front end set and the piezoelectric element set can be adhered to each other with accurate positioning by bringing the adhesive-coated front end set and the piezoelectric element set into contact with each other to adhere them together. At this time, the front and set and the piezoelectric element set are positioned with the gap between the side walls of the housing and the piezoelectric element set.

Because the positioning jig is used to position the piezoelectric elements with respect to the diaphragm, that is, as represented by the positioning plate, the piezoelectric element can be positioned accurately with respect to the diaphragm even if the various components have variation in machining precision, because the actual positioning is performed using the positioning jig while observing relative positions of the diaphragm and the piezoelectric element. There is no need to provide a highly accurate positioning reference surface in the housing or manage the thickness of adhesive and the like in the manner of the conventional ink jet print head.

Further, because the gap is maintained between the housing and the piezoelectric element fixing plate, the housing and the piezoelectric element fixing plate do not contact each other. Therefore, no warping will occur from differences in expansion even if the housing and the piezoelectric element fixing plate are formed from different materials with different expansion coefficients. Therefore, the ink jet print head can be made inexpensively and with reduced variation in ink ejection properties.

BRIEF DESCRIPTION OF THE DRAWINGS

The above and other objects, features and advantages of the invention will become more apparent from reading the following description of the embodiment and its modifications taken in connection with the accompanying drawings in which.

DETAILED DESCRIPTION OF THE EMBODIMENT

Figure 1:
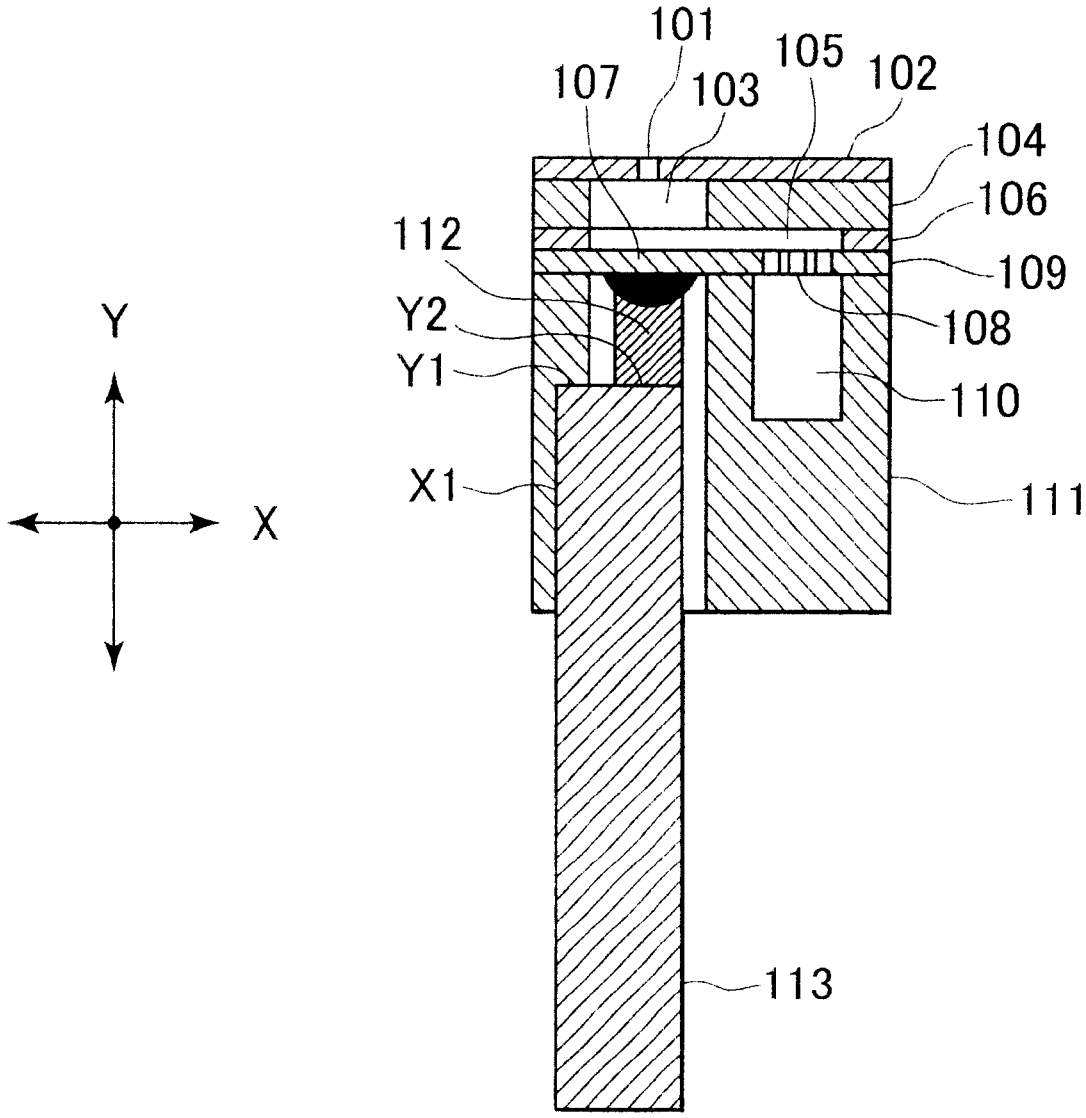
FIG.1 PRIOR ART
FIG. 1 is a cross-sectional view schematically showing a conventional ink jet print head.
Figure 3:
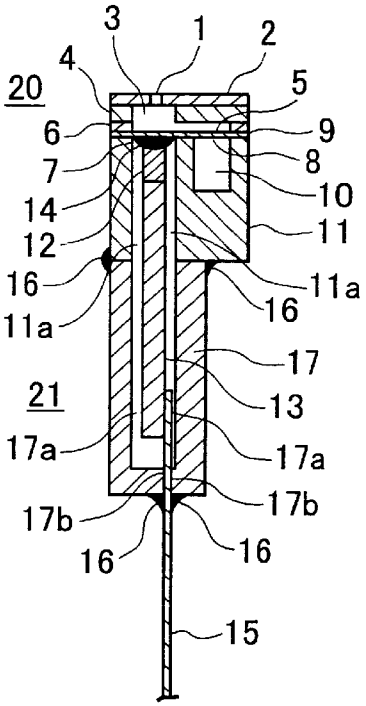
FIG. 3 is a right side cross-sectional view showing the ink jet print head of FIG. 2.
Figure 2:
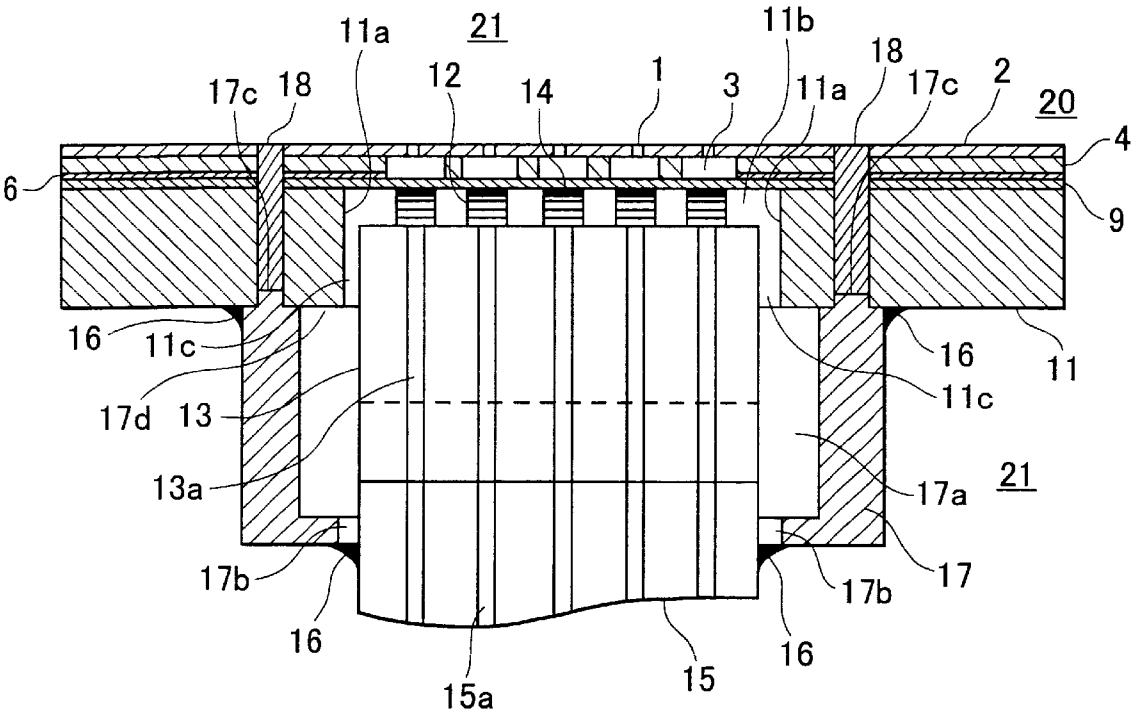
FIG. 2 is a frontal cross-sectional view showing an ink jet print head according to an embodiment of the present invention.
Figure 4:
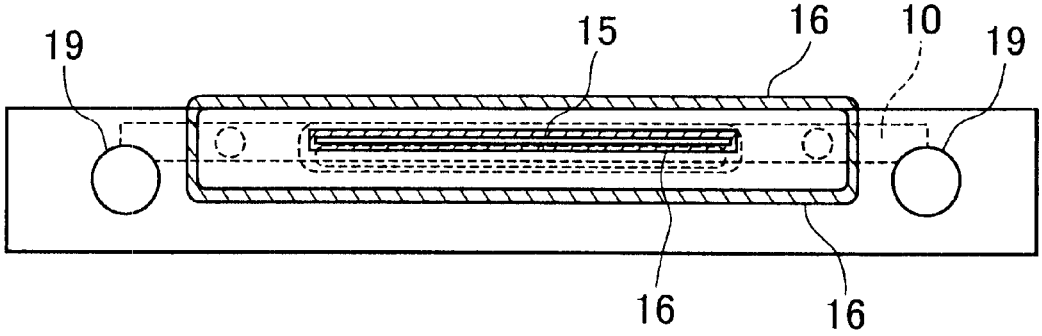
FIG. 4 is a lower view in partial cross-section showing sealing between a cover and a housing, and between the cover and a flexible cable, of the ink jet print head shown in FIG. 2, with the cover omitted from the drawing to facilitate understanding.
Figure 5:
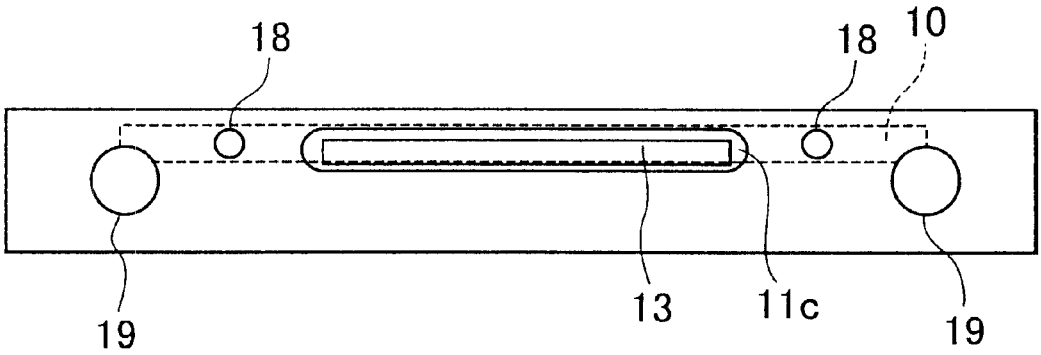
FIG. 5 is a lower view showing a gap between the housing and a piezoelectric element fixing plate, with the cover and the flexible cable omitted from the drawing to facilitate understanding.

An ink jet print head according to an embodiment of the present invention is described referring to FIGS. 2 to 5. The ink jet print head includes a front end set 20, a piezoelectric element set 21, and a cover 17. The front end set 20 includes an orifice plate 2, a chamber plate 4, a restrictor plate 6, a diaphragm plate 9, and a housing 11. The chamber plate 4 is formed with pressure chambers 3. The orifice plate 2 is formed with nozzles 1 in a one-to-one correspondence with the pressure chambers 3. Each nozzle 1 brings a corresponding pressure chamber 3 into fluid communication with atmosphere. The restrictor plate 6 is formed with restrictors 5, which serve as channels for supplying ink to the pressure chambers 3. The diaphragm plate 9 includes a diaphragm portion 7 and a filter 8. The housing 11 is formed with a common ink channel 10, internal side walls 11*a*, positioning holes 18, and ink supply ports 19. The internal side walls 11*a* adjoin the diaphragm portion 7 at one side to define a space 11*b* that is open at an end opposite from the diaphragm portion 7. The positioning holes 18 are filled with sealing or adhesive.

The piezoelectric element set 21 is disposed at least partially in the apace 11*b*. A gap 11*c* exists between the piezoelectric element fixing plate 13 and the internal side walls 11*a* that define the space 11*b*, because the space 11*b* of the housing 11 is larger than the piezoelectric element 12 and the piezoelectric element fixing plate 13. The piezoelectric element set 21 includes piezoelectric elements 12 and a piezoelectric element fixing plate 13. The piezoelectric elements 12 are attached to the piezoelectric element fixing plate 13 with a predetermined positioning. The piezoelectric elements 12 are attached to the diaphragm portion 7 with adhesive 14. The piezoelectric element fixing plate 13 is fixedly attached to and supports the piezoelectric elements 12 and includes a conductor pattern 13*a*. It should be noted that a conductor pattern 15*a* of a flexible cable 15 is connected to the conductor pattern 13*a* of the piezoelectric element fixing plate 13 so that signals can be applied to the piezoelectric elements 12 through the conductor pattern 15*a* of the flexible cable 15 and the conductor pattern 13*a* of the piezoelectric element fixing plate 13.

The cover 17 includes cover positioning protrusions 17*c*, a flexible-cable-side opening 17*b*, and a front-end-side opening 17*d*. The cover positioning protrusions 17*c* are fitted in the positioning holes 18 of the housing 11. The cover 17 is fitted over the piezoelectric element fixing plate 13 via the front-end-aide opening 17*d* so as to cover the piezoelectric element fixing plate 13. The internal space of the cover 17 is large enough to completely encompass the portion of the fixing plate 13 that protrudes from the housing 11 and still maintain a gap 17*a* between the cover 17 and the piezoelectric element fixing plate 13. The opening 17*b* is located substantially in confrontation with the space 11*b*, with the fixing plate 13 disposed therebetween. The flexible cable 15 extends through the opening 17*b* into connection with the fixing plate 13. Sealing agent 16 or adhesive is applied where the cover 17 connects with the housing 11 and in between the opening 17*b* and the flexible cable 15.

Next, the method of producing the ink jet print head will be described while referring to FIGS. 6 to 13. First, the front end set 20 and the piezoelectric element set 21 are prepared. It should be noted that the nozzles 1, the pressure chambers 3, and the piezoelectric elements 12 are all provided in a mutual one-to-one correspondence. Also, a positioning plate 114 is prepared with positioning holes 115 and dummy chambers 116 with the same size and mutual positioning as the positioning holes 18 and pressure chamber 3 of the front and set 20. As will be described later, the positioning plate 114 is used to represent the front end set 20 while positioning the piezoelectric element set 21.

Figure 6:
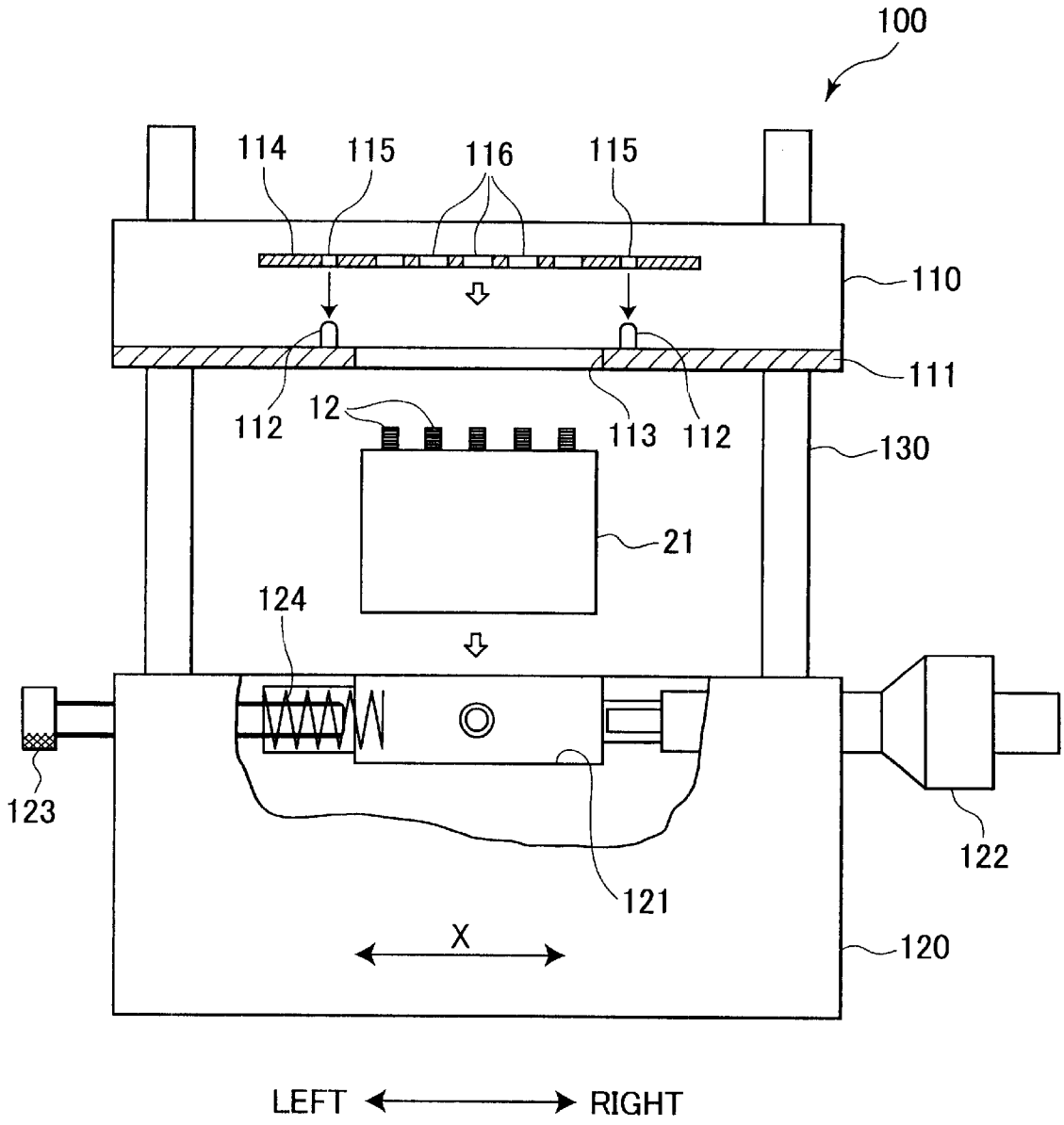
FIG. 6 is a frontal view in partial cross section showing a positioning plate and a piezoelectric element set mounted on a positioning jig.
Figure 7:
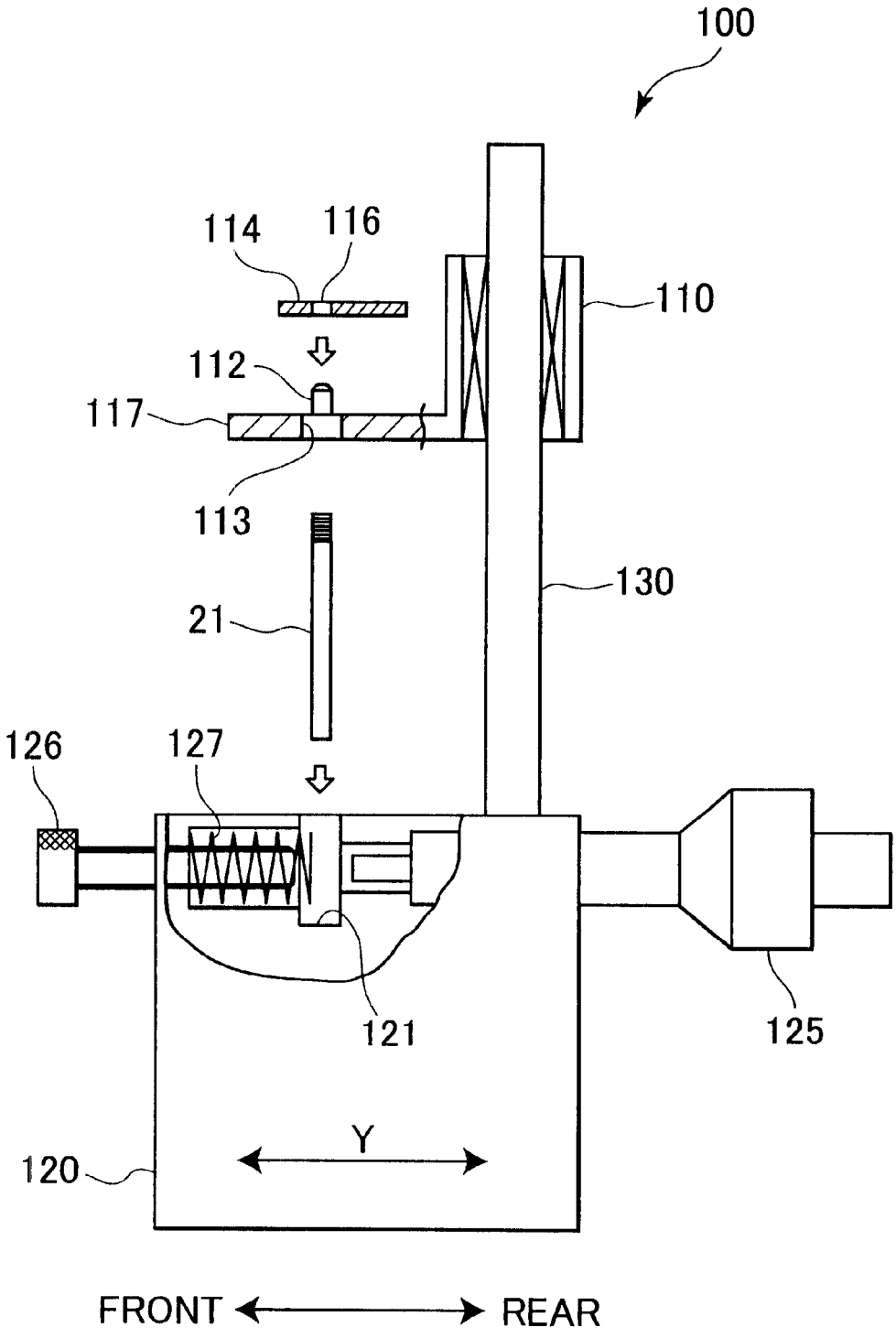
FIG. 7 is a right side view in partial cross section of the view of the FIG. 6.

Then, the front end set 20 and the piezoelectric element set 21 are mounted on a positioning jig 100. The positioning jig 100 is used for positioning and adhering the front end set 20 to the piezoelectric element set 21. As shown in FIGS. 6 and 7, the positioning jig 100 includes a front-end-set base 110, a piezoelectric element-element-set base 120, and a guiding jig having a linear movement guide 130. The linear movement guide 130 is fixed on the piezoelectric element-element-set base 120 and front-end-set base 110 is mounted on the linear movement guide 130 so as to be movable toward and away from the piezoelectric element-element-set base 120. The front-end-set base 110 has a substantial reclining L-shape when viewed from the side. The front-end-set base 110 includes a frontward-protruding shelf 111 formed with an opening 113 in its substantial center and with positioning pins 112 at left and right sides of the opening 113. The piezoelectric element-element-set base 120 includes a support surface 121, X- and Y-direction micrometer heads 122, 125, and fixing screws 123, 126. The fixing screws 123, 126 include springs 124, 127, respectively.

Figure 8:
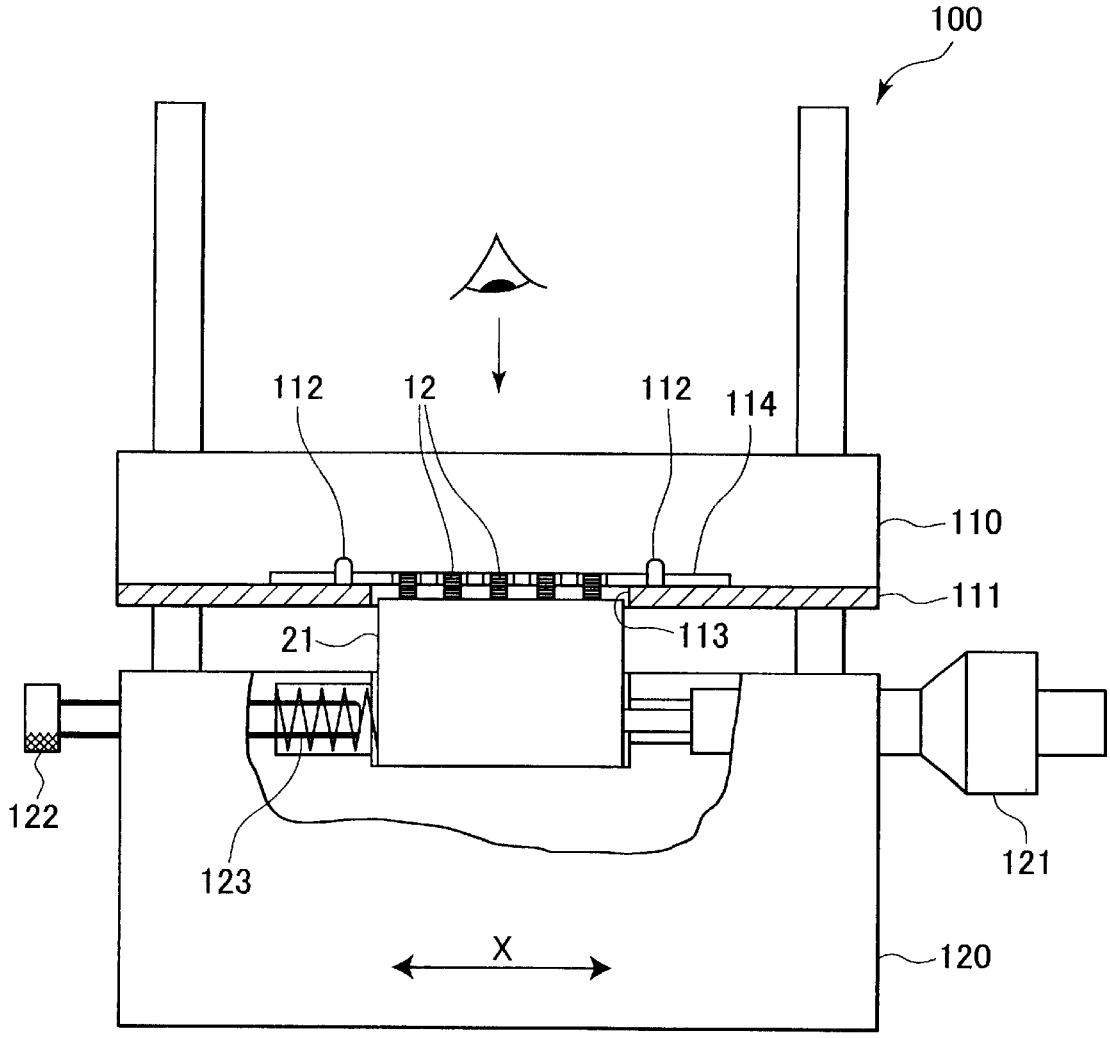
FIG. 8 is a frontal view in partial cross section showing the piezoelectric element set being positioned with respect to the positioning plate using the positioning jig.
Figure 9:
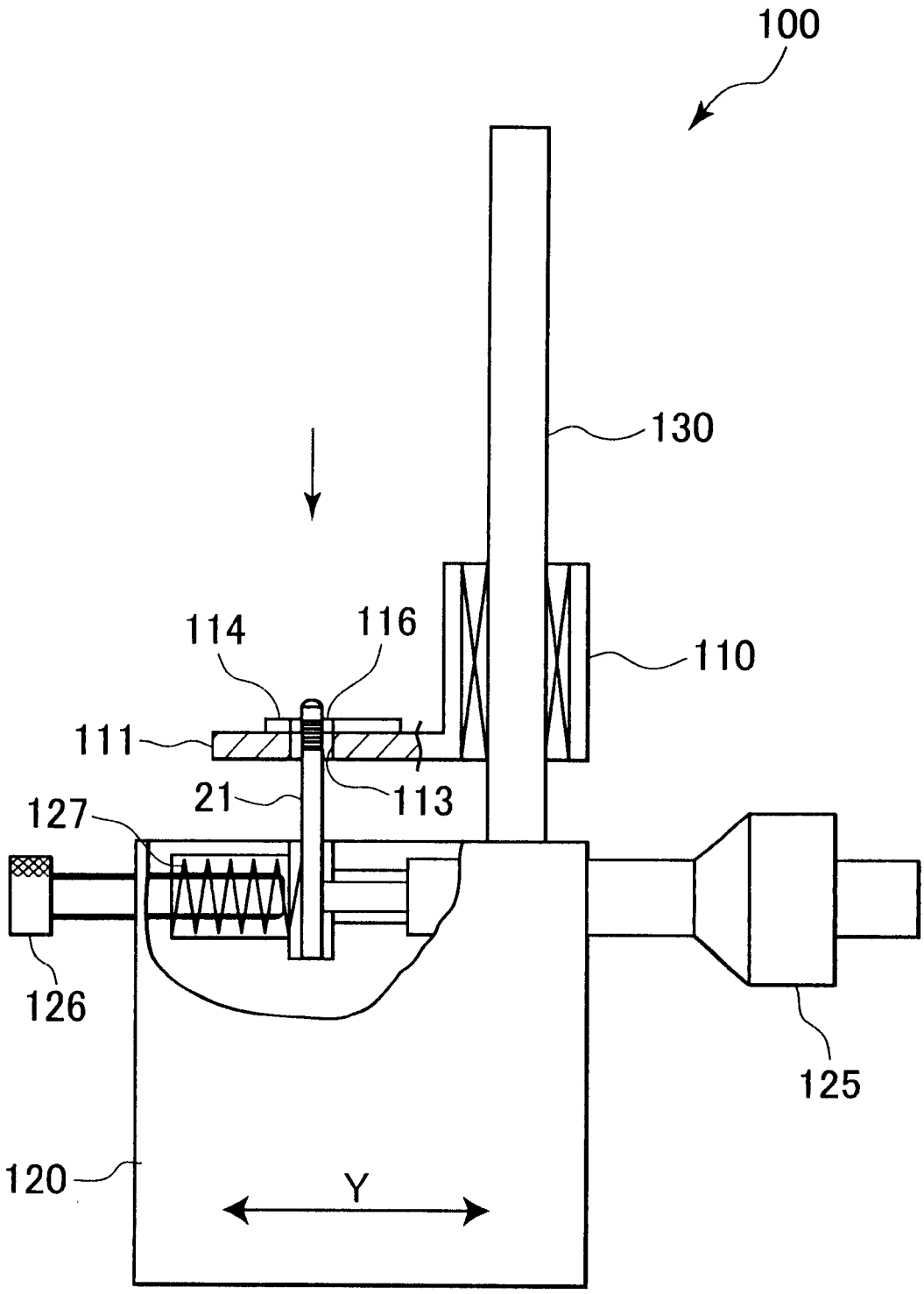
FIG. 9 is a right side view in partial cross section of the view of the FIG. 8.

The piezoelectric element set 21 is placed on the support surface 121. The positioning plate 114 is placed on the shelf 111 by fitting the positioning pine 112, 112 into the positioning holes 115, 115. Then, the front-end-set base 110 is moved following the linear movement guide 130 of the guiding jig downward toward the piezoelectric element-element-set base 120. While the front-end-sot base 110 moves downward, the operator views the piezoelectric elements 12 from above through the dummy chambers 116 and the opening 113. Said differently, the operator views the surface of the piezoelectric elements 12 that will be adhered to the diaphragm plate 9, from the direction of the adhering surface of the diaphragm plate 9 (assuming the positioning plate 114 were replaced with the front end set 20). While observing the piezoelectric elements 12, the operator uses the X- and Y-micrometer heads 121, 125 to move the piezoelectric element set 21 by minute distances in the X and Y directions until, as shown in FIGS. 8 and 9, each piezoelectric element 12 is aligned with a corresponding dummy chamber 116. Then, the position of the piezoelectric element set 21 is fixed in place using the fixing screws 122, 126. It should be noted that two or more each of the X- and Y-direction micrometer heads can be provided to improve accuracy of positioning the piezoelectric element set 21.

Figure 11:
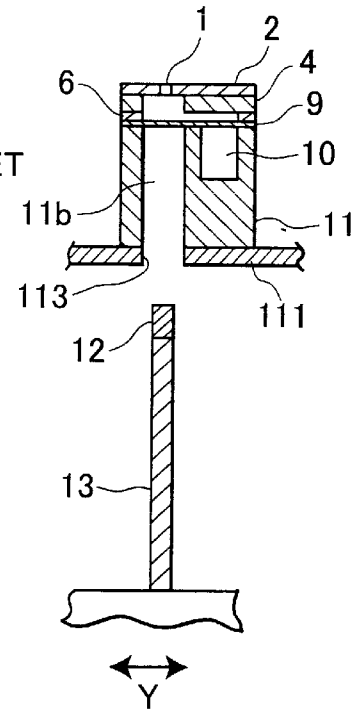
FIG. 11 is a right side view in partial cross section of the view of the FIG. 10.
Figure 10:
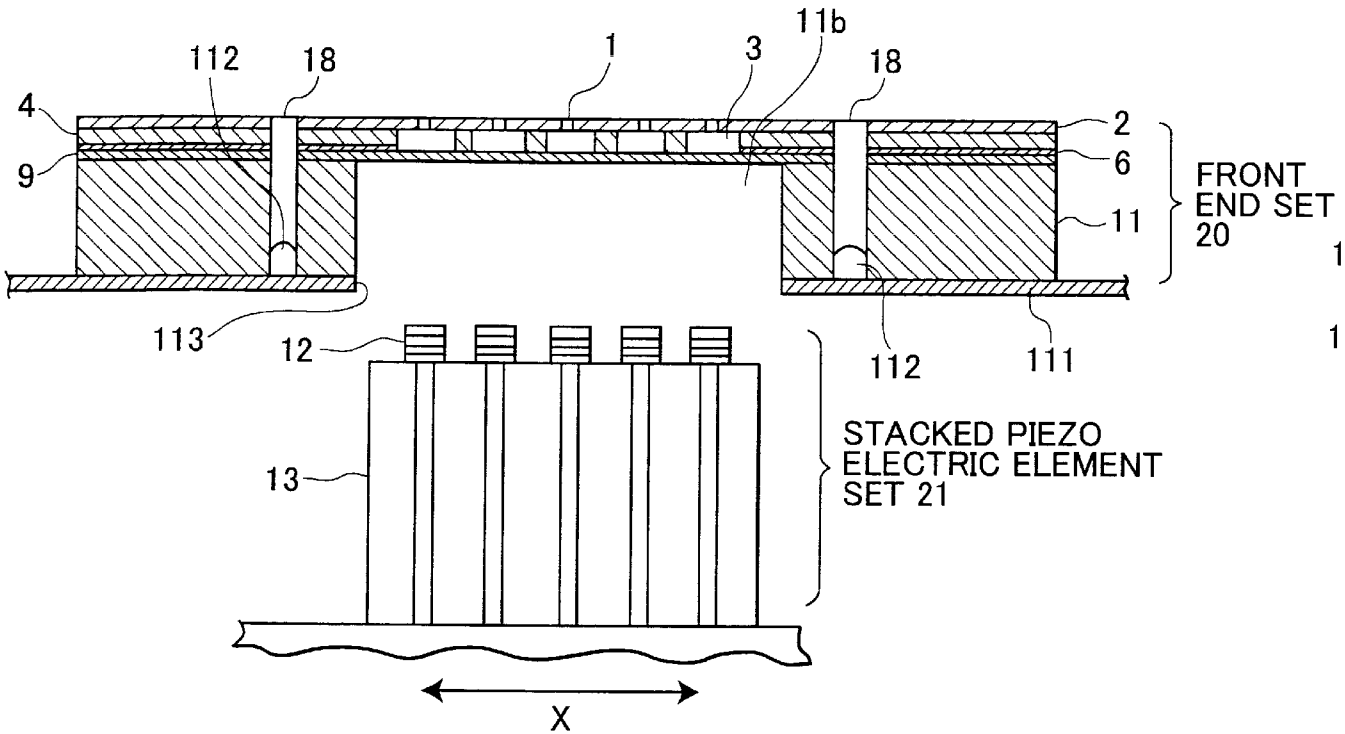
FIG. 10 is a frontal view in partial cross section showing a front end set mounted on the positioning jig in place of the positioning plate.
Figure 12:
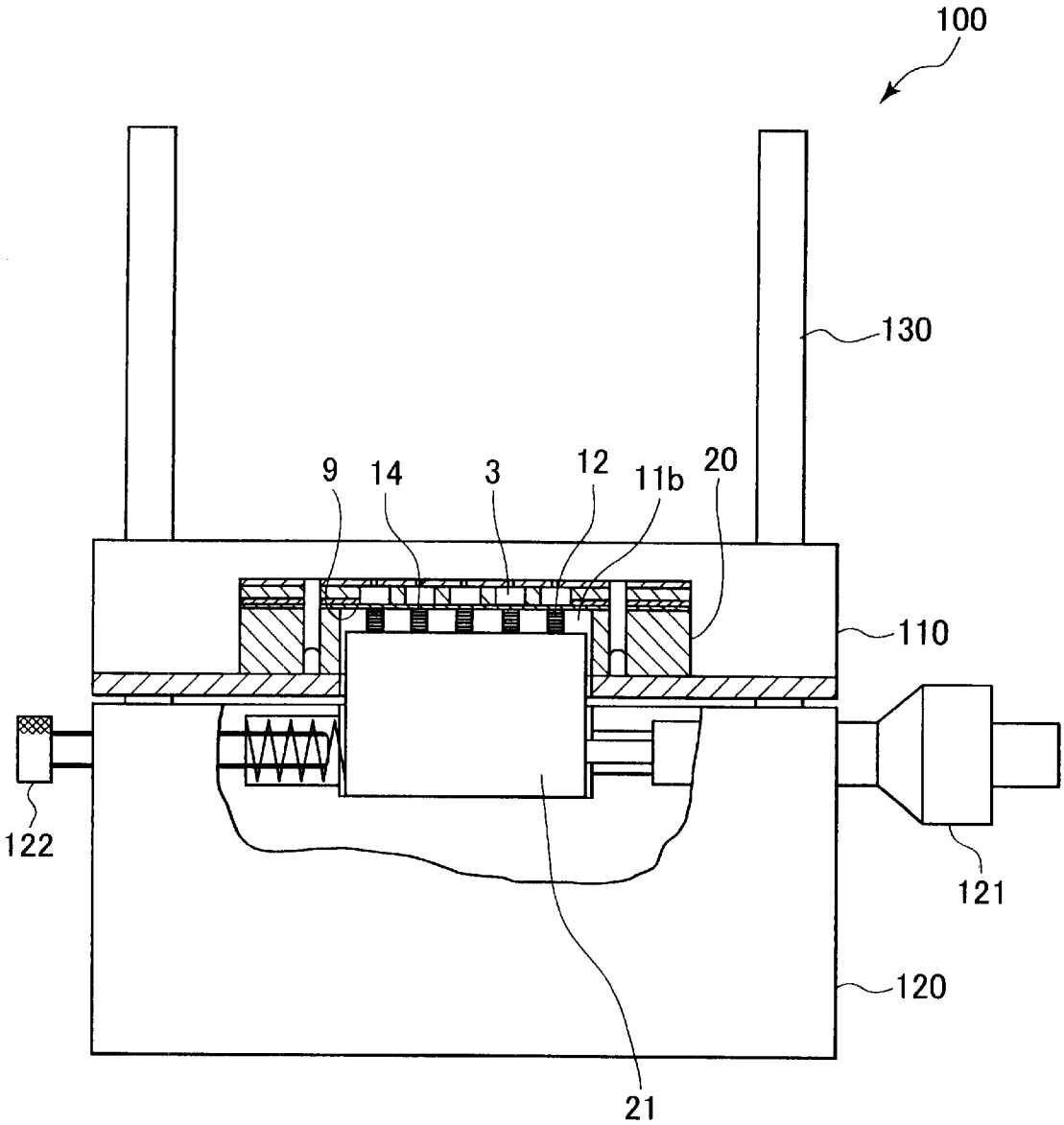
FIG. 12 is a frontal view in partial cross section showing the front end set and the piezoelectric element set being adhered together on the positioning jig.
Figure 13:
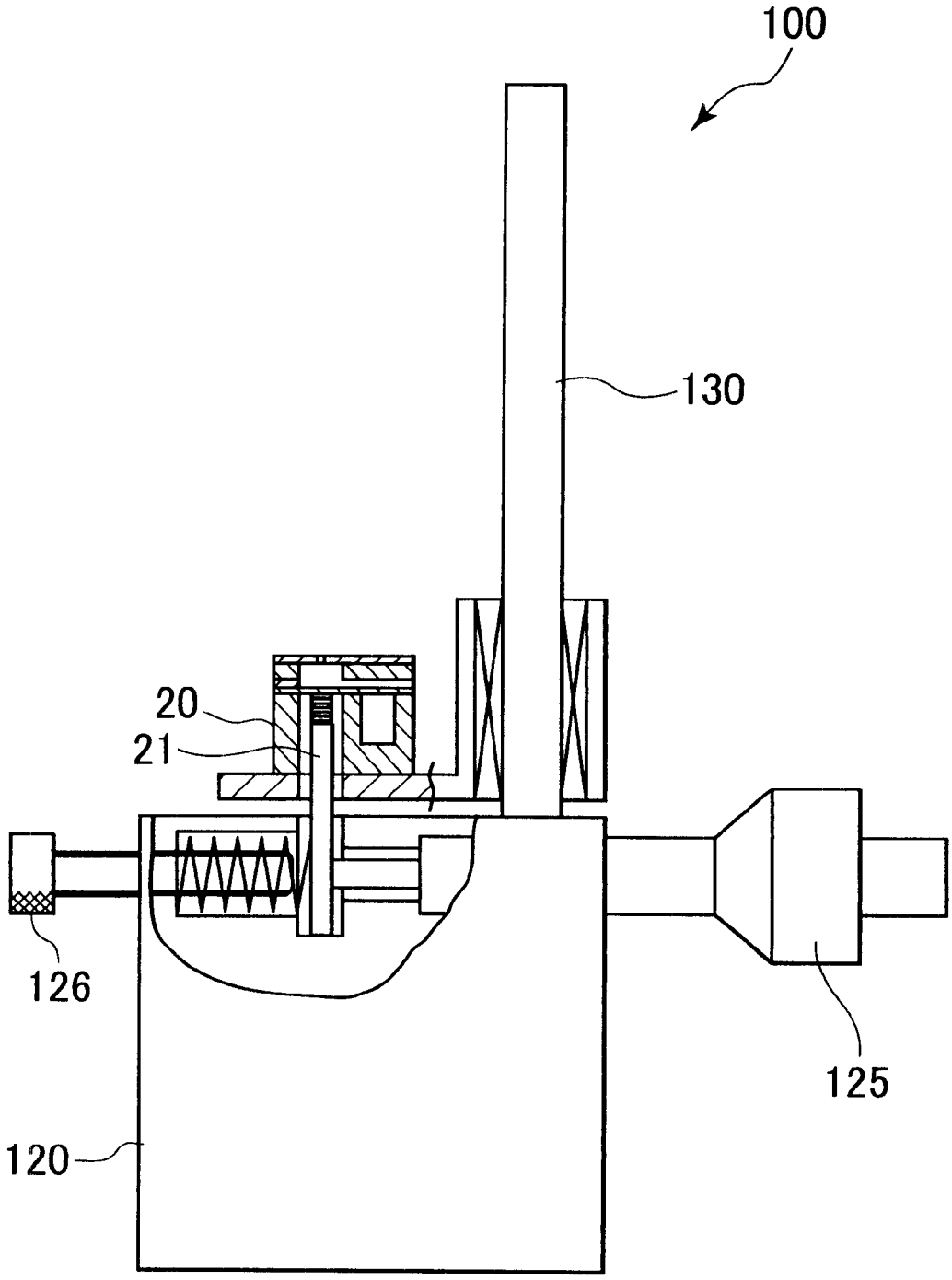
FIG. 13 is a right side view in partial cross section of the view of the FIG. 12.

Then, the front-end-set base 110 is raised upward and the positioning plate 114 is removed from the shelf 111. Next, as shown in FIGS. 10 and 11, the front end set 20 is placed on the shelf 11 by fitting the positioning pins 112, 112 into the positioning holes 18, 18. Adhesive 14, while still uncured, is coated on either the diaphragm portion 7 or the piezoelectric elements 12.

Then, the front-end-set base 110 is moved downward toward the piezoelectric element-element-set base 120 using the positioning jig 100. At this time, the linear movement guide 130 maintains alignment between the front end set 20 and the piezoelectric element set 21. The front-end-set base 110 is moved downward until the piezoelectric element set 21 passes into the space 11*b* and, as shown in FIGS. 10 and 11, the diaphragm portion 7 and the piezoelectric elements 12 contact each other. As a result, the piezoelectric elements 12 of the piezoelectric element set 21 are adhered to the diaphragm portion 7 by the adhesive 14.

At this time, each piezoelectric element 16 will be positioned accurately in confrontation with a corresponding pressure chamber 3 because the positioning holes 115 and the dummy chambers 116 of the positioning plate 114 have the same positional relationship as the positioning holes 18 and the pressure chambers 3 of the front end set 20. The method of the present invention enables this accurate alignment without the need to provide a highly accurate positioning reference surface in the housing and without the need to manage the thickness of adhesive and the like in the manner of the conventional ink jet print head. Moreover, the front end set 20 and the piezoelectric element set 21 are positioned and adhered together with the gap 11*c* between the side walls 11*a* of the housing 11 and the fixing plate 13. Therefore, the piezoelectric element 12 and the diaphragm portion 7 can be positioned accurately even if there is a certain amount of variation in machining precision of the components.

Further, because the housing 11 and piezoelectric element fixing plate 13 do not contact each other, no warping will occur from differences in expansion even if the housing 11 and the piezoelectric element fixing plate 13 are formed from different materials with different expansion coefficients. Therefore, the ink let print head can be made inexpensively and with reduced variation in ink ejection properties.

Next, the adhered front and set 20 and the piezoelectric element set 21 are removed from the positioning jig 100. The cover 17 is then mounted over the piezoelectric element fixing plate 13 without contacting the piezoelectric element fixing plate 13 until the piezoelectric element fixing plate 13 is covered by the cover 17. The cover positioning protrusions 17*c* of the cover 17 are inserted into the positioning holes 18 of the housing 11 and the cover 17 is fixed in place using adhesive and the like (not shown). Sealing agent is introduced into the positioning holes 18 or the housing 11.

Because the opening 17*b* of the cover 17 is larger than the piezoelectric element fixing plate 13 in the same way as the space 11*b* of the housing 11, the cover 17 will not press against the piezoelectric element set 21 during mounting of the cover 17. Moreover the cover will protect the piezoelectric element set 21 from external force.

Next, the flexible cable 15 is passed through the opening 17*b* of the cover 17. The conductor pattern 15*a* of the flexible cable 15 is connected to the conductor pattern 13*a* of the piezoelectric element fixing plate 13. Then, sealing agent 16 is coated on the adhered surfaces of the cover 17 and also between the opening 17*b* of the cover 17 and the flexible cable 15.

Figure 14:
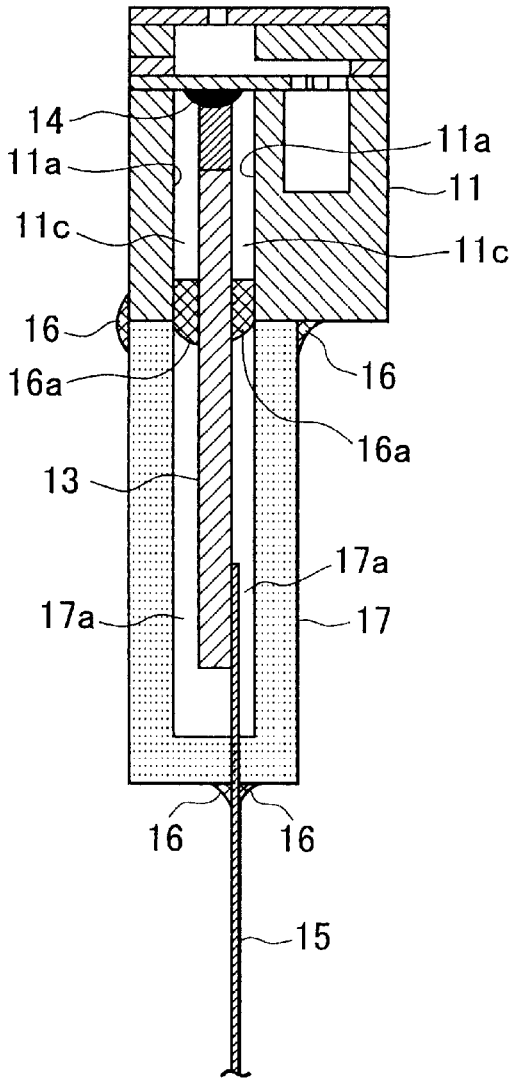
FIG. 14 is a side cross-sectional view showing an ink jet print head according to a first modification of the present invention.

FIG. 14 shows an ink let print head according to a first modification of the present invention. In the first modification, before the cover 17 is attached to the housing 11, sealing agent 16*a* or adhesive is introduced into the gap 11*c* between the side walls 11*a* of the housing 11 and the piezoelectric element fixing plate 13. It should be noted that the seating agent 16*a* could be the same or different material of the sealing agent 16. The sealing agent 16*a* or adhesive serves as a resilient member that maintains the piezoelectric elements 12 in a predetermined positioning without completely fixing the piezoelectric element fixing plate 13 to the housing 11, so the same effects can be achieved as in the embodiment.

The sealing agent 16*a* or adhesive can be applied intermittently at a plurality of positions between the piezoelectric element fixing plate 13 and the housing 11 to achieve the effect of maintaining the piezoelectric elements 12 in a predetermined positioning. However, when the sealing agent 16*a* or adhesive is applied in the gap 11*c* in a continuous seal around the piezoelectric element fixing plate 13, then the added benefit of preventing ink and the like from entering into the gap 11*c* can be achieved. If ink were to enter the gap 11*a*, then short circuits that adversely effect operations could occur.

When the sealing agent 16*a* or adhesive has a Shore-A hardness of 90 degrees or less, then the sealing agent or adhesive is soft and the housing 11 and the fixing plate 13 are not completely fixed in place. In this case, the same results can be achieved as if no sealing agent or adhesive, that is, a sealing agent or adhesive with Shore-A hardness of 0 degrees, were provided in the gap between the housing 11 and the fixing plate 13 as in the embodiment. Furthermore, the ink jet head can be better protected from external vibration and the like. This good effect can be achieved whether the sealing agent or adhesive is applied intermittently at a plurality of positions between the housing 11 and the fixing plate 13 or in a continuous seal completely around the fixing plate 13. The ink jet head according to the present invention has enhanced durability and reliability.

The same effects can be achieved if, in addition to the sealing agent 16*a* or adhesive having a Shore-A hardness of 90 degrees or less, the adhesive for attaching the piezoelectric elements 12 to the diaphragm portion 7 has a shore A hardness of 80 degrees or less. An adhesive with high hardness shrinks a great deal when hardening. When the adhesive for attaching the piezoelectric elements 12 to the diaphragm portion 7 has a shore A hardness of greater than 80 degrees, the reduction in volume during hardening excessively pulls on the piezoelectric element fixing plate 13 so that ink ejection properties of the corresponding pressure chamber can be affected. Variations in ink ejection properties can result. Also, an adhesive with a shore A hardness of greater than 80 degrees cannot effectively absorb differences in deformation amount caused by different coefficients of thermal expansion between the diaphragm/filter plate 109 and the piezoelectric element fixing plate 13 of the piezoelectric element set 21.

Figure 15:
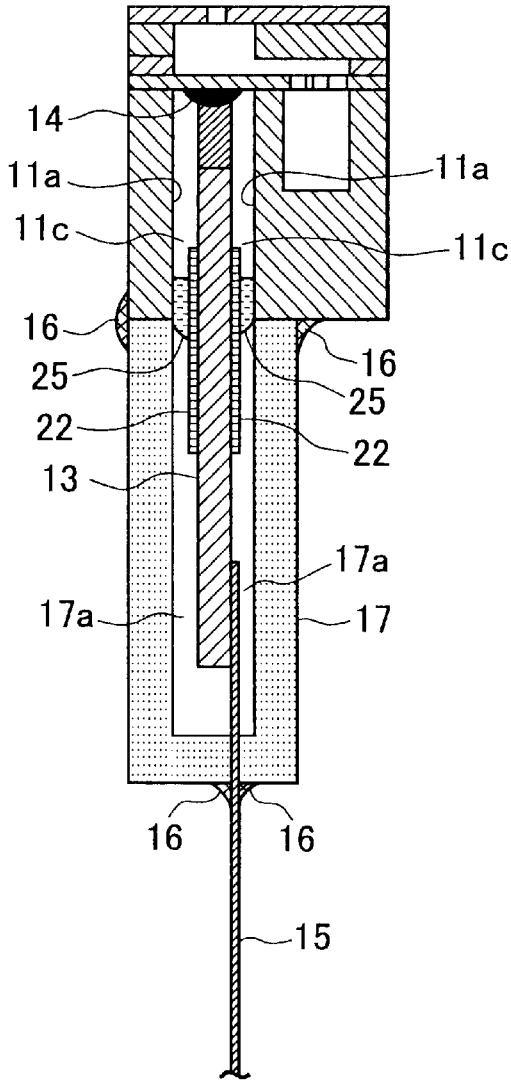
FIG. 15 is a side cross-sectional view showing an ink jet print head according to a second modification of the present invention.

FIG. 15 shows an ink jet print head according to a second modification of the present invention. A member 22, such as a film, that freely slides against the piezoelectric element fixing plate 13 is disposed against the piezoelectric element fixing plate 13. Then adhesive 25 or sealing material is introduced into the gap 11*c* between the side walls 11*a* of the housing 11 and the piezoelectric element fixing plate 13 an a plurality of positions. Because the member 22 is provided, the adhesive 25 or sealing material can be an adhesive or sealing material with any hardness. That is, the adhesive 25 or sealing material can be have a low hardness, a high hardness, or something in between and the piezoelectric elements 12 can be accurately maintained at a desired position after being positioned, without firing the housing 11 and the piezoelectric element fixing plate 13 together. Therefore, the same effects can be achieved as in the embodiment.

Figure 16:
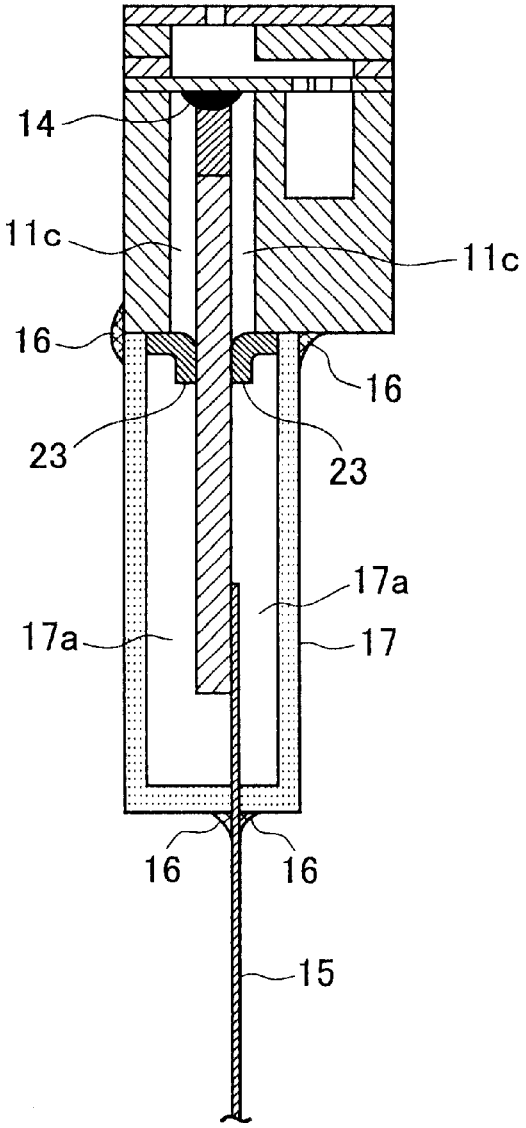
FIG. 16 is a side cross-sectional view showing an ink jet print head according to a third modification of the present invention.

FIG. 16 is a side cross-sectional view showing an ink jet print head according to a third modification of the present invention. In the third modification, an elastic support member 23 that supports the piezoelectric element fixing plate 13 is provided to either the housing 11 or the cover 17. The elastic support member 23 presses against the piezoelectric element fixing plate and freely slides against the piezoelectric element fixing plate 13. With this configuration also, the piezoelectric elements 12 can be accurately maintained at a desired position after being positioned, without fixing the housing 11 and the piezoelectric element fixing plate 13 together. Therefore, the same effects can be achieved as in the embodiment.

Figure 17:
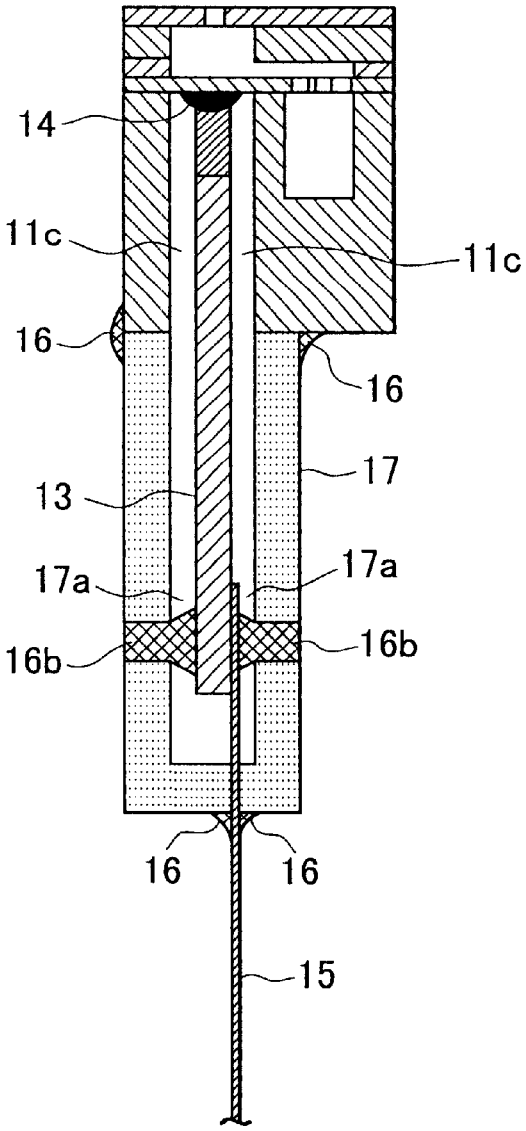
FIG. 17 is a side cross-sectional view showing an ink jet print head according to a fourth modification of the present invention.

FIG. 17 is a side cross-sectional view showing an ink jet print head according to a fourth modification of the present invention. In the fourth modification, through holes are formed in the cover 17 at positions in confrontation with the piezoelectric element fixing plate 13. Then sealing agent 16*b* or adhesive is introduced into the gap 17*a* between the cover 17 and the piezoelectric element fixing plate 13 through the through holes until the sealing agent 16*b* or adhesive fills the through holes and at least the portion of the gap 11*a* located between the piezoelectric element fixing plate 13 and the through holes. The sealing agent 16*b*, which may or may not be the same as sealing agent 16, or adhesive serves as a resilient member so that the piezoelectric elements 12 can be accurately maintained at a desired position after being positioned, without fixing the housing 11 and the piezoelectric element fixing plate 13 together. Therefore, the same effects can be achieved as in the embodiment.

Figure 18:
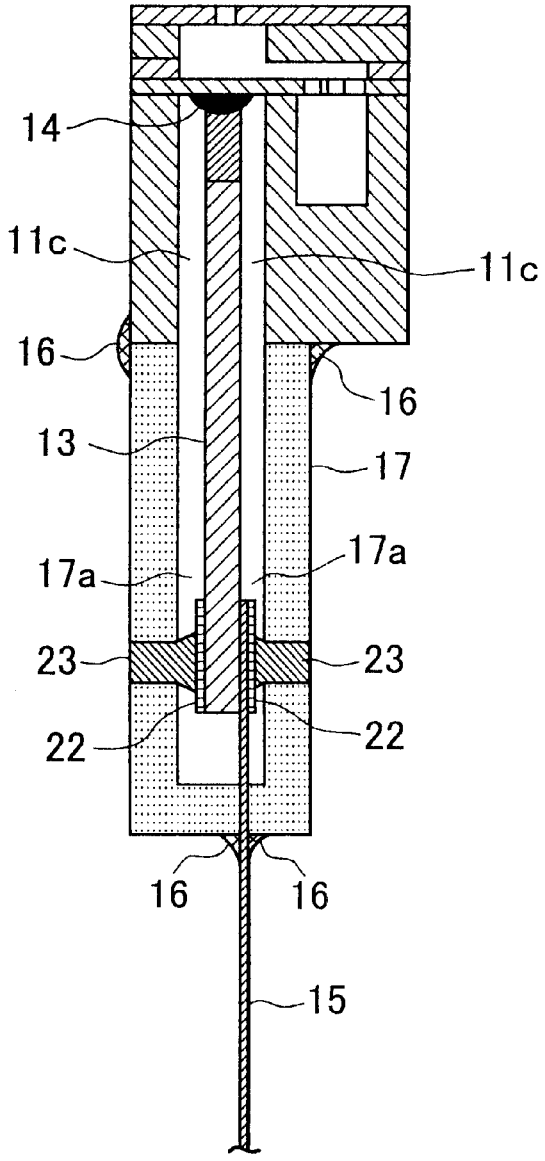
FIG. 18 is a side cross-sectional view showing an ink jet print head according to a fifth modification of the present invention.

FIG. 18 is a side cross-sectional view showing an ink jet print head according to a fifth modification of the present invention. According to the fifth modification, member 22, such as a film, is freely-slidably disposed against the piezoelectric element fixing plate 13. Through holes are opened in the cover 17 and then the adhesive 23 or sealing agent is introduced into the space 17*a* between the cover 17 and the member 22 through the through holes. As a result, the member 22 is freely-slidably disposed against the piezoelectric element fixing plate 13 at a position between the piezoelectric element fixing plate 13 and the adhesive 23 or sealing agent. In this modification also, the adhesive 23 or sealing agent need not have any specified hardness. With this configuration, the piezoelectric elements 12 can be accurately maintained at a desired position after being positioned, without fixing the housing 11 and the piezoelectric element fixing plate 13 together. Therefore, the same effects can be achieved as in the embodiment.

Figure 19:
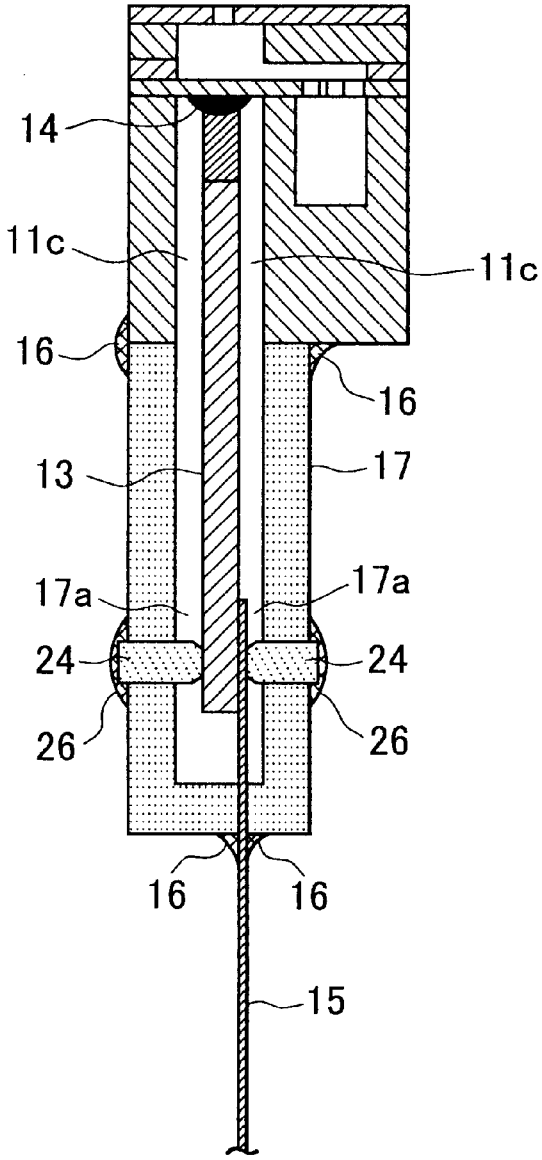
FIG. 19 is a side cross-sectional view showing an ink jet print head according to a sixth modification of the present invention.

FIG. 19 is a side cross-sectional view showing an ink jet print head according to a sixth modification of the present invention. In the sixth modification, through holes are formed in the cover 17 at positions in confrontation with the piezoelectric element fixing plate 13. Support members 24 are inserted through the through holes into freely slidable abutment with the piezoelectric element fixing plate 13. One or more springs (not shown) are provided for pressing the support members 24 against the opposite sides of the piezoelectric element fixing plate 13. Then, the support members 24 are fixed in place using an adhesive 26, sealing agent, and the like. The adhesive 26 or sealing agent can have any hardness. With this configuration also, the piezoelectric elements 12 can be accurately maintained at a desired position after being positioned, without fixing the housing 11 and the piezoelectric element fixing plate 13 together. Therefore, the same effects can be achieved as in the embodiment.

According to the present invention, the diaphragm and the piezoelectric elements 12 are aligned using the jig 100, the gap 11*c* is maintained between the side walls 11*a* in the housing 11 and the piezoelectric element fixing plate 13, and moreover the cover 17 is fixed onto the housing 11. The cover 17 is provided with a front-end-side opening 17*d* and an internal space substantially the same size as the space 11*b* in the housing 11 (as viewed in FIG. 3) so that the cover 17 can be mounted over the piezoelectric element set 21 while maintaining the gap 17*a*. With this configuration, variation in ink ejection properties can be reduced and the ink jet head can be inexpensively produced. Moreover, the positioning of the piezoelectric element set 21 and the piezoelectric element set 21 can be protected.

What is claimed is:

1. An ink jet print head comprising:

a pressure chamber portion with pressure chambers;

an orifice plate formed with nozzles in a one-to-one correspondence with the pressure chambers, each nozzle bringing a corresponding pressure chamber into fluid communication with atmosphere;

a restrictor plate formed with ink channels in fluid communication with the pressure chambers;

a diaphragm forming a side of the pressure chambers;

piezoelectric elements each having a first end face and a second end face opposite from the first end face, the first end faces of the piezoelectric elements being attached to the diaphragm in a one-to-one correspondence with the pressure chambers, each piezoelectric element generating, through the diaphragm, a pressure fluctuation in a corresponding pressure chamber when applied with an electric signal;

a piezoelectric element fixing plate fixedly attached to the second end faces of the piezoelectric elements and supporting the piezoelectric elements;

a housing including:

a common ink channel portion formed with a common ink channel in fluid communication with the channels in the restrictor plate; and internal side walls that adjoin the diaphragm at one side to define a space that is opens at an end opposite from the diaphragm, the piezoelectric element fixing plate and the piezoelectric elements being disposed at least partially in the space with a gap existing between the piezoelectric element fixing plate and the internal side walls that define the space; and a cover that covers the piezoelectric element fixing plate, the cover being connected to the housing and being provided with an internal space large enough to maintain a gap between the cover and the piezoelectric element fixing plate.

2. An ink jet print head as claimed in claim 1, wherein the cover is formed with through holes at positions in confrontation with the piezoelectric element fixing plate, at least one of adhesive and sealing agent filling the through holes and at least a portion of the gap between the piezoelectric element fixing plate and the through holes.

3. An ink jet print head as claimed in claim 2, wherein a member is freely-slidably disposed against the piezoelectric element fixing plate at a position between the piezoelectric element fixing plate and the at least one of adhesive and sealing agent.

4. An ink jet print head as claimed in claim 1, wherein the cover is formed with through holes at positions in confrontation with the piezoelectric element fixing plate, support members being disposed in the through holes and in abutment with the piezoelectric element fixing plate.

5. An ink jet print head as claimed in claim 1, further comprising an elastic support member that supports the piezoelectric element fixing plate, the elastic support member being provided to the cover and pressing against the piezoelectric element fixing plate.

6. An ink jet print head as claimed in claim 1, further comprising at least one of sealing agent and adhesive that at least partially fills the gap between the piezoelectric element fixing plate and the internal side walls of the space in the housing.

7. An ink jet print head as claimed in claim 6, wherein the at least one of sealing agent and adhesive has a Shore A hardness of 90 degrees or less.

8. An ink jet print head as claimed in claim 6, further comprising a member interposed between the at least one of sealing agent and adhesive and the piezoelectric element fixing plate.

9. An ink jet print head as claimed in claim 1, further comprising:

an adhesive that attaches the piezoelectric elements to the diaphragm, the adhesive having a Shore A hardness of 80 degrees or less; and at least one of sealing agent and adhesive that at least partially fills the gap between the piezoelectric element fixing plate and the internal side walls of the space in the housing, at least one of sealing agent and adhesive having a Shore A hardness of 90 degrees or less.

10. An ink jet print head as claimed in claim 1, further comprising an elastic support member that supports the piezoelectric element fixing plate, the elastic support member being provided to the housing and pressing against the piezoelectric element fixing plate.

* * * * *